US007047186B2

(12) United States Patent
Oishi

(10) Patent No.: US 7,047,186 B2
(45) Date of Patent: May 16, 2006

(54) VOICE DECODER, VOICE DECODING METHOD AND PROGRAM FOR DECODING VOICE SIGNALS

(75) Inventor: Toru Oishi, Tokyo (JP)

(73) Assignee: NEC Electronics Corporation, Kanagawa (JP)

( * ) Notice: Subject to any disclaimer, the term of this patent is extended or adjusted under 35 U.S.C. 154(b) by 520 days.

(21) Appl. No.: 09/984,420

(22) Filed: Oct. 30, 2001

(65) Prior Publication Data

US 2002/0052739 A1 May 2, 2002

(30) Foreign Application Priority Data

Oct. 31, 2000 (JP) ..... 2000/332482

(51) Int. Cl.

| | |
|---|---|
| ***G10L 19/14*** | (2006.01) |
| ***G10L 19/04*** | (2006.01) |
| ***G10L 19/08*** | (2006.01) |
| ***G10L 19/10*** | (2006.01) |
| ***G10L 19/00*** | (2006.01) |

(52) U.S. Cl. ..... 704/205; 704/219; 704/201

(58) Field of Classification Search ..... 704/230, 704/258, 262, 500

See application file for complete search history.

(56) References Cited

U.S. PATENT DOCUMENTS

| | | | | |
|---|---|---|---|---|
| 4,330,689 | A * | 5/1982 | Kang et al. | 704/219 |
| 5,761,190 | A * | 6/1998 | Yamauchi et al. | 370/210 |
| 5,778,335 | A * | 7/1998 | Ubale et al. | 704/219 |
| 5,809,472 | A * | 9/1998 | Morrison | 704/500 |
| 6,049,537 | A * | 4/2000 | Proctor et al. | 370/342 |
| 6,067,517 | A * | 5/2000 | Bahl et al. | 704/256 |
| 6,167,372 | A * | 12/2000 | Maeda | 704/207 |
| 6,633,841 | B1 * | 10/2003 | Thyssen et al. | 704/233 |
| 6,681,202 | B1 * | 1/2004 | Miet et al. | 704/214 |
| 6,732,070 | B1 * | 5/2004 | Rotola-Pukkila et al. | 704/219 |
| 6,804,340 | B1 * | 10/2004 | Howard et al. | 379/202.01 |
| 2001/0027390 | A1 * | 10/2001 | Rotola-Pukkila et al. | 704/219 |
| 2003/0004711 | A1 * | 1/2003 | Koishida et al. | 704/223 |
| 2003/0189900 | A1 * | 10/2003 | Barany et al. | 370/229 |

FOREIGN PATENT DOCUMENTS

| | | | |
|---|---|---|---|
| EP | 417739 | A2 * | 3/1991 |
| EP | 0 890 943 | A2 | 1/1999 |
| EP | 1 024 477 | A1 | 8/2000 |

* cited by examiner

*Primary Examiner*—Susan McFadden
*Assistant Examiner*—Matthew J Sked
(74) *Attorney, Agent, or Firm*—Foley & Lardner LLP

(57) ABSTRACT

A voice decoder comprises the first voice decoding circuit which is specialized for decoding narrow band voice signal, the second voice decoding circuit which is specialized for decoding wide band voice signals, and a band determination circuit which determines whether a target signal to be decoded is a narrow band voice signal or wide band voice signal. The band determination circuit supplies the first voice decoding circuit with the target signal in a case where it is determined that the target signal is a narrow band voice signal, and supplies the second voice decoding circuit with the target signal in a case where it is determined that the target signal is a wide band voice signal. The first voiced decoding circuit decodes the supplied target signal. The second voice decoding circuit decodes the supplied target signal.

12 Claims, 5 Drawing Sheets

VOICE DECODER, VOICE DECODING METHOD AND PROGRAM FOR DECODING VOICE SIGNALS

BACKGROUND OF THE INVENTION

1. Field of the Invention

The present invention relates to a voice decoder, a voice decoding method and a program for decoding voice signals.

2. Description of the Related Art

Wire telephones and cellular phones send encoded voice signals (in a bit stream), converts (decodes) and outputs any of those bit streams which have been transmitted from another terminal device, etc.

Conventionally, most techniques for encoding/decoding voices signals are developed for encoding/decoding narrow band voices signals. In recent years, however, methods for encoding/decoding both narrow and wide band voice signals, such as the multi-path excitation mode of MPEG-4/CELP (Moving Picture Experts Group-4/Code Excited Linear Prediction), have been being spread.

Generally, each apparatus for encoding/decoding both the narrow and wide band voice signals is formed as follows: An apparatus specialized for handing narrow band voice signals is formed with a module specialized or optimized for handling narrow band voice signals. Then, an appropriate change is made in this apparatus, thereby forming an apparatus which can handle both narrow and wide band voice signals. The formed apparatus mainly includes the above module optimized for handling narrow band voice signals.

It should be noted, however, that the calculation accuracy of the module specialized for encoding/decoding the narrow band may not be sufficient for handling the wide band voice signal, in the case of fixed-point representation. Hence, if the wide band voice signals are decoded using the module for narrow band voice signals, only low quality of voices reproduced using decoded wide band voice signals may be obtained.

Further, in the case where an apparatus handling both the narrow and wide band voice signals is formed with a module having a sufficient level of calculation accuracy for handling wide band voice signals, unnecessary calculations may be processed when handling narrow band voice signals. This results in lowering the processing speed of the apparatus.

SUMMARY OF THE INVENTION

It is accordingly an object of the present invention to provide an apparatus, method and program for decoding voices signals with high efficiency and realizing high quality voices reproduced using the decoded voice signals.

In order to attain the above object, according to the first aspect of the present invention, there is provided a voice decoder comprising a first voice decoding circuit which is specialized for decoding at least one encoded narrow band voice signal, a second voice decoding circuit which is specialized for decoding at least one encoded wide band voice signal, and a band determination circuit which determines whether a target signal to be decoded is a narrow band voice signal or a wide band voice signal.

The band determination circuit supplies the first voice decoding circuit with the target signal in a case where it is determined that the target signal is a narrow band voice signal, and supplies the second voice decoding circuit with the target signal in a case where it is determined that the target signal is a wide band voice signal.

The first voice decoding circuit decodes the target signal supplied from the band determination circuit and the second voice decoding circuit decodes the target signal supplied from the band determination circuit.

According to this invention, voice signals can be decoded with high efficiency, and hence realizing high quality voices reproduced using the decoding voice signals.

The band determination circuit may include an LSP generation circuit which generates at least one LSP (Linear Spectrum Pair) from an index included in the target signal and an LSP determination circuit which determines whether the target signal is a narrow band voice signal or a wide band voice signal, by determining whether number of the at least one LSP is equal to or larger than a predetermined number.

According to the second aspect of the present invention, there is provided a voice decoder comprising an LSP generation circuit which generates at least one LSP from an encoded narrow band voice signal or wide band voice signal as a target signal to be decoded, a converter which converts the at least one LSP into at least one LPC (Linear Prediction Code), an excitation signal generator which generates an excitation signal for use in linear prediction synthesis, from the target signal, and a voice signal generator which generates a narrow band voice signal or wide band voice signal by performing linear prediction synthesis using the at least one LPC and the excitation signal.

The converter comprises a first conversion circuit which converts the at least one LSP into the at least one LPC with an adequate level of calculation accuracy for decoding narrow band voice signals and a second conversion circuit which converts the at least one LSP into the at least one LPC with an adequate level of calculation accuracy for decoding wide band voice signals.

The converter also comprises a first supply circuit which determines whether the target signal is a narrow band voice signal or wide band voice signal by determining whether number of the at least one LSP is equal to or larger than a predetermined number, supplies the first conversion circuit with the at least one LSP in a case where it is determined that the target signal is a narrow band voice signal, and supplies the second conversion circuit with the at least one LSP in a case where it is determined that the target signal is a wide band voice signal.

The voice signal generator comprises a first synthesis filter which performs linear prediction synthesis using the at least one LPC generated by the first conversion circuit and the excitation signal, with an adequate level of calculation accuracy for decoding narrow band voice signals, and a second synthesis filter which performs linear prediction synthesis using the at least one LPC generated by the second conversion circuit and the excitation signal, with an adequate level of calculation accuracy for decoding wide band voice signals. The voice signal generator also comprises a second supply circuit which determines whether the target signal is a narrow band voice signal or wide band voice signal by determining whether number of the at least one LSP is equal to or larger than a predetermined number, supplies the first synthesis filter with the excitation signal in a case where it is determined that the target signal is a narrow band voice signal, and supplies the second synthesis filter with the excitation signal in a case where it is determined that the target signal is a wide band voice signal.

The excitation signal generator may comprise a vector signal generation circuit which generates an adaptive code vector signal from the target signal to be decoded, and a pulse signal generation circuit which generates a pulse signal from the target signal.

The excitation signal generator may also comprise a first gain generation circuit which generates gains of the respective adaptive code vector signal and pulse signal using the target signal and the at least one LPC generated by the first conversion circuit, with an adequate level of calculation accuracy for decoding narrow band voice signals, a second gain generation circuit which generates gains of the respective adaptive code vector signal and pulse signal using the target signal and the at least one LPC generated by the second conversion circuit, with an adequate level of calculation accuracy for decoding wide band voice signals, and a third supply circuit which determines whether the target signal is a narrow band voice signal or wide band voice signal by determining whether number of the at least one LSP is equal to or larger than a predetermined number, supplies the first gain generation circuit with the target signal in a case where it is determined that the target signal is a narrow band voice signal, and supplies the second gain generation circuit with the target signal in a case where it is determined that the target signal is a wide band voice signal.

Furthermore, the excitation signal generator may comprise an excitation signal generation circuit which generates the excitation signal, using the gains generated by the first or second gain generation circuit, the adaptive code vector signal and the pulse signal.

According to the third aspect of the present invention, there is provided a voice decoder comprising an LSP generation circuit which generates at least one LSP from an encoded narrow band voice signal or wide band voice signal as a target signal to be decoded, a converter which converts the at least one LSP into at least one LPC, an excitation signal generator which generates an excitation signal for use in performing linear predication synthesis from the target signal, and a voice signal generator which generates a narrow band voice signal or wide band voice signal, by performing linear prediction synthesis using the at least one LPC and the excitation signal.

The voice signal generator includes a first synthesis filter which performs linear prediction synthesis using the at least one LPC and excitation signal, with an adequate level of calculation accuracy for decoding narrow band voice signals, and a second synthesis filter which performs linear prediction synthesis using the at least one LPC and excitation signal, with an adequate level of calculation accuracy for decoding wide band voice signals.

The voice signal generator also includes a first supply circuit which determines whether the target signal is a narrow band voice signal or wide band voice signal by determining whether number of the at least one LPC is equal to or larger than a predetermined number, supplies the first synthesis filter with the at least one LPC in a case where it is determined that the target signal is a narrow band voice signal, and supplies the second synthesis filter with the at least one LPC in a case where it is determined that the target signal is a wide band voice signal, and a second supply circuit which determines whether the target signal is a narrow band voice signal or wide band voice signal by determining whether number of the at least one LSP is equal to or larger than a predetermined number, supplies the first synthesis filter with the excitation signal in a case where it is determined that the target signal is a narrow band voice signal, and supplies the second filter with the excitation signal in a case where it is determined that the target signal is a wide band voice signal.

The excitation signal generator may include a vector signal generation circuit which generates an adaptive code vector signal from the target signal to be decoded, and a pulse signal generation circuit which generates a pulse signal from the target signal to be decoded.

The excitation signal generator may also include a first gain generation circuit which generates gains of the respective adaptive code vector signal and the pulse signal using the at least one LPC and the target signal, with an adequate level of calculation accuracy for decoding narrow band voice signals, a second gain generation circuit which generates gains of the respective adaptive code vector signal and the pulse signal using the at least one LPC and the target signal, with an adequate level of calculation accuracy for decoding wide band voice signals, and a third supply circuit which determines whether the target signal is a narrow band voice signal or wide band voice signal by determining whether number of the at least one LSP is equal to or larger than a predetermined number, supplies the first gain generation circuit with the target signal in a case where it is determined that the target signal is a narrow band voice signal, and supplies the second gain generation circuit with the target signal in a case where it is determined that the target signal is a wide band voice signal.

Furthermore, the excitation signal generator may include an excitation signal generation circuit which generates the excitation signal, using the gains generated by the first or second gain generation circuit, the adaptive code vector signal and the pulse signal.

The first supply circuit supplies the first gain decoding circuit with the at least one LPC in a case where it is determined that the target signal is a narrow band voice signal, and supplies the second gain decoding circuit with the at least one LPC in a case where it is determined that the target signal is a wide band voice signal.

According to the fourth aspect of the present invention, there is provided a voice decoding method comprising determining whether a target signal to be decoded is a narrow band voice signal or wide band voice signal, decoding the target signal with an adequate level of calculation accuracy for decoding narrow band voice signals, in a case where it is determined that the target signal is a narrow band voice signal, and decoding the target signal with an adequate level of calculation accuracy for decoding wide band voice signals, in a case where it is determined that the target signal is a wide band voice signal.

The determining the target signal may include generating at least one LSP by decoding an index included in the target signal and determining whether the target signal is a narrow band voice signal or wide band voice signal, by determining whether number of the at least one LSP is equal to or larger than a predetermined number.

According to the fifth aspect of the present invention, there is provided a program for controlling a computer to function as a voice decoder comprising a first voice decoding circuit which is specialized for decoding at least one encoded narrow band voice signal a second voice decoding circuit which is specialized for decoding at least one encoded wide band voice signal, and a band determination circuit which determines whether a target signal to be decoded is a narrow band voice signal or wide band voice signal.

The band determination circuit supplies the first voice decoding circuit with the target signal in a case where it is determined that the target signal is a narrow band voice signal, and supplies the second voice decoding circuit with the target signal in a case where it is determined that the target signal is a wide band voice signal, the first voice decoding circuit decodes the target signal supplied from the band determination circuit, and the second voice decoding circuit decodes the target signal supplied from the band determination circuit.

BRIEF DESCRIPTION OF THE DRAWINGS

The object and other objects and advantages of the present invention will become more apparent upon reading of the following detailed description and the accompanying drawings in which.

DETAILED DESCRIPTION OF THE PREFERRED EMBODIMENTS

First Embodiment

A voice decoder according to the first embodiment of the present invention will now be explained with reference to the accompany drawings.

Figure 1:
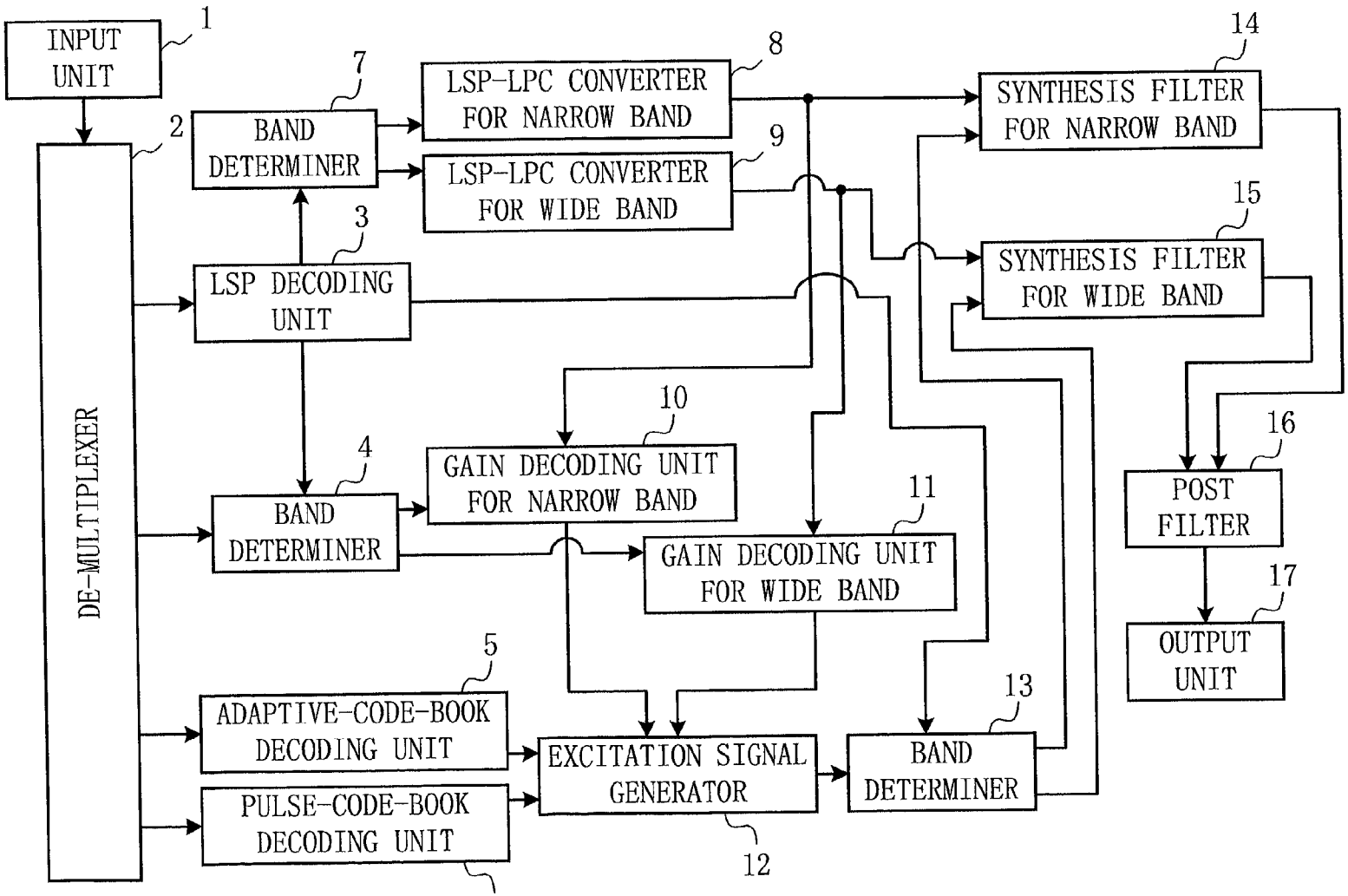
FIG. 1 is a diagram showing the structure of a voice decoder according to the first embodiment of the present invention.

The voice decoder according to the first embodiment comprises, as shown in FIG. 1, an input unit 1, a de-multiplexer 2, an LSP decoding (generation) unit 3, a band determiner 4, an adaptive-code-book decoding (generation) unit 5, a pulse-code-book decoding (generation) unit 6, a band determiner 7, an LSP-LPC converter for narrow band 8, an LSP-LPC converter for wide band 9, a gain decoding (generation) unit for narrow band 10, a gain decoding (generation) unit for wide band 11, an excitation signal generator 12, a band determiner 13, a synthesis filter for narrow band 14, a synthesis filter for wide band 15, a post filter 16 and an output unit 17. Note that the post filter 16 may be excluded from the voice decoder of this embodiment.

For example, the input unit 1, the de-multiplexer 2, the LSP decoding unit 3, the adaptive-code-book decoding unit 5, the pulse-code-book decoding unit 6, the LSP-LPC converters 8 and 9, the gain decoding units 10 and 11, the excitation signal generator 12, the synthesis filters 14 and 15, the post filter 16 and the output unit 17 are modules based on MPEG-4/CELP (Moving Picture Experts Group-4/Code Excited Linear Prediction) as the ISO MPEG4.

The voice decoder of this embodiment includes a plurality of dedicated modules which are specialized for decoding encoded narrow band voice signals and a plurality of dedicated modules for decoding encoded wide band voice signals. As will be explained later, the voice decoder switches one set of modules to another set of modules in accordance with whether the signal to be decoded is a narrow band voice signal or wide band voice signal. The voice decoder may decode either of the narrow band and wide band voice signals one from another by each frame (processing unit) of the voice signal.

The input unit 1 receives voice signals (narrow band and wide band voice signals) which are so-called a bit-stream and coded by a voice coding apparatus (not illustrated), and inputs the received signals to the de-multiplexer 2. The bit-stream includes indexes respectively corresponding to an LSP (Line Spectrum Pair), a gain, an adaptive code vector and a pulse signal.

The de-multiplexer 2 divides the bit stream into the indexes, and provides the LSP decoding unit 3, the band determiner 4, the adaptive-code-book decoding unit 5 and the pulse-code-book decoding unit 6 respectively with the indexes. Specifically, the de-multiplexer 2 provides the LSP decoding unit 3 with an LSP index, the band determiner 4 with a gain index, the adaptive-code-book decoding unit 5 with an adaptive code vector index, and the pulse-code-book decoding unit 6 with a pulse signal index.

The LSP decoding unit 3 generates the LSPs by decoding the provided LSP index, and outputs the generated LSPs to the band determiners 4, 7 and 13.

The band determiner 4 determines whether a target signal to be decoded is a narrow band or wide band voice signal, using the provided LSPs. Specifically, the number of LSPs to be employed for decoding the narrow band voice signals differs from the number of LSPs to be employed for decoding the wide band voice signals. In the case where the number of LSPs is less than a predetermined value, the band determiner 4 determines that the target signal is a narrow band voice signal. On the contrary, in the case where the number of LSPs is equal to or greater than a predetermined value, the band determiner 4 determines that the target signal is a wide band voice signal. In the case where it is determined that the target signal is a narrow band voice signal, the band determiner 4 outputs the provided gain index to the gain decoding unit 10. On the contrary, in the case where it is determined that the target signal is a wide band voice signal, the band determiner 4 outputs the supplied gain index to the gain decoding unit 11.

The adaptive-code-book decoding unit 5 generates an adaptive code vector signal by decoding the adaptive-code-vector index, and outputs the generated signal to the excitation signal generator 12.

The pulse-code-book decoding unit 6 generates a pulse signal by decoding the provided pulse signal index, and outputs the generated signal to the excitation signal generator 12.

Similar to the band determiner 4, the band determiner 7 determines whether a target signal to be decoded is a narrow band or wide band voice signal, based on the LSPs provided from the LSP decoding unit 3. In the case where it is determined that the target signal is a narrow band voice signal, the band determiner 7 outputs the LSPs to the LSP-LPC converter 8 for narrow band. On the other hand, in the case where it is determined that the target signal is a wide band voice signal, the band determiner 7 outputs the LSPs to the LSP-LPC converter 9 for wide band.

The LSP-LPC converter 8 has an optimum level of calculation accuracy for decoding narrow band voice signals. The LSP-LPC converter 8 converts the provided LSPs into LPCs (Linear Prediction Codes), and outputs the LPCs to the gain decoding unit 10 and synthesis filter 14. Note that each of the LPC is a linear prediction coefficient.

The LSP-LPC converter 9 has a higher level of calculation accuracy than that of the LSP-LPC converter 8. Particularly, the LSP-LPC converter 9 has an optimum level of calculation accuracy for decoding wide band voice signals. The LSP-LPC converter 9 converts the provided LSPs into LPCs. For example, while LSP-LPC converter 8 converts the LSPs into LPCs with sixteen bit accuracy, the LSP-LPC converter 9 converts the LSPs into LPCs with thirty two bit accuracy. The LSP-LPC converter 9 outputs the LPCs to the gain decoding unit 11 and synthesis filter 15.

The gain decoding unit 10 has an optimum level of calculation accuracy for decoding the narrow band voice signals. The gain decoding unit 10 generates the gains of the respective adaptive code vector signal and pulse signal, using the gain index from the band determiner 4 and the LPCs from the LSP-LPC converter 8. The gain decoding unit 10 outputs the generated gains to the excitation signal generator 12.

The gain decoding unit 11 has a higher level of calculation accuracy than that of the gain decoding unit 10. Particularly, the gain decoding unit 11 has an optimum level of calculation accuracy for decoding wide band voice signals. The gain decoding unit 11 generates gains of the respective adaptive code vector signal and pulse signal, using the gain index from the band determiner 4 and the LPCs from the LSP-LPC converter 9. For example, while the gain decoding unit 10 generates the gains with sixteen bit accuracy, the gain decoding unit 11 generates the gains with thirty two bit accuracy. The gain decoding unit 11 outputs the generated gains to the excitation signal generator 12.

The excitation signal generator 12 generates excitation signals, using the provided adaptive code vector signal, the provided pulse signal and the provided gains. Particularly, the excitation signal generator 12 multiplies the gain of the provided adaptive code vector signal by the adaptive code vector signal from the adaptive-code-book decoding unit 5, and multiplies the gain of the provided pulse signal by the pulse signal from the pulse-code-book decoding unit 6. After this, the excitation signal generator 12 adds two signals of the multiplication results so as to generate an excitation signal, and outputs the generated excitation signal to the band determiner 13.

Similar to the band determiners 4 and 7, the band determiner 13 determines whether a target signal to be decoded is a narrow band or wide band voice signal, using the LSPs provided from the LSP decoding unit 3. In the case where it is determined that the target signal to be decoded is a narrow band voice signal, the band determiner 13 outputs the provided excitation signal to the synthesis filter 14. On the contrary, in the case where it is determined that the target signal to be decoded is a wide band voice signal, the band determiner 13 outputs the excitation signal to the synthesis filter 15.

The synthesis filter 14 has an optimum level of calculation accuracy for decoding narrow band voice signals. The synthesis filter 14 performs linear prediction synthesis, using the LPCs provided from the LSP-LPC converter 8 and the excitation signal from the band determiner 13. Having performed this, the synthesis filter 14 generates a narrow band voice signal. Then, synthesis filter 14 outputs the generated narrow band voice signal to the post filter 16.

The synthesis filter 15 has a higher level of calculation accuracy than that of the synthesis filter 14. Particularly, the synthesis filter has an optimum level of calculation accuracy for decoding wide band voice signals. The synthesis filter 15 performs linear prediction synthesis, using the LPCs provided from the LSP-LPC converter 9 and the excitation signal from the band determiner 13. Having performed this, the synthesis filter 15 generates a wide band voice signal. For example, while the synthesis filter 14 generates a narrow band voice signal with sixteen bit accuracy, the synthesis filter 15 generates a wide band voice signal with thirty two bit accuracy. The synthesis filter 15 outputs the generated wide band voice signal to the post filter 16.

The post filter 16 converts the provided narrow and wide band voice signals into an auditory satisfactory voice signal. For example, the post filter 16 removes any unnecessary components (e.g. noise components, etc.) from the provided narrow and wide band voice signals. Then, the post filter 16 outputs the voice signal to a predetermined circuit or device through the output unit 17.

Operations of the voice decoder according to the first embodiment of the present invention will now be described.

The de-multiplexer 2 divides the bit stream input from the input unit 1 into indexes respectively corresponding to an LSP, a gain, an adaptive code vector and a pulse signal.

The de-multiplexer 2 provides the LSP decoding unit 3 with the LSP index, the band determiner 4 with the gain index, the adaptive-code book decoding unit 5 with the adaptive code vector index and the pulse-code-book decoding unit 6 with the pulse signal index.

The LSP decoding unit 3 generates LSPs by decoding the provided LSP index, and outputs the generated LSP to the band determiners 4, 7 and 13.

The band determiner 7 determines whether a target signal to be decoded is a narrow or wide band voice signal, using the provided LSPs.

In the case where it is determined that the target signal is a narrow band voice signal, the band determiner 7 outputs the provided LSPs to the LSP-LPC converter 8. The LSP-LPC converter 8 converts the provided LSPs into LPCs with an optimum level of calculation accuracy for decoding the narrow band voice signal. The LSP-LPC converter 8 outputs the LPCs to the gain decoding unit 10 and the synthesis filter 14.

On the contrary, in the case where it is determined that the target signal is a wide band voice signal, the band determiner 7 outputs the provided LSPs to the LSP-LPC converter 9. The LSP-LPC converter 9 converts the provided LSPs into LPCs with an optimum level of calculation accuracy for decoding the wide band voice signal. The LSP-LPC converter 9 outputs the LPCs to the gain decoding unit 11 and the synthesis filter 15.

The band determiner 4 determines whether the target signal to be decoded is a narrow or wide band voice signal, using the LSPs provided from the LSP decoding unit 3.

In the case where it is determined that the target signal is a narrow band voice signal, the band determiner 4 outputs the provided gain index to the gain decoding unit 10. The gain decoding unit 10 generates gains of the respective adaptive code vector signal and pulse signal, using the provided gain index and LPCs, at an optimum level of calculation accuracy for decoding the narrow band voice signal. Then, the gain decoding unit 10 outputs the gains of the adaptive code vector signal and pulse signal to the excitation signal generator 12.

On the contrary, in the case where it is determined that the target voice signal is a wide band voice signal, the band determiner 4 outputs the provided gain index to the gain decoding unit 11. The gain decoding unit 11 generates gains of the respective adaptive code vector signal and pulse signal, using the provided gain index and LPCs, at an optimum level of calculation accuracy for decoding the wide band voice signal. The gain decoding unit 11 outputs the gains of the respective adaptive code vector signal and pulse signal to the excitation signal generator 12.

The excitation signal generator 12 multiplies the gain of the adaptive code vector signal by the adaptive code vector signal, and multiplies the gain of the pulse signal by the pulse signal.

Then, the excitation signal generator 12 adds two signals of the multiplication results so as to generate an excitation signal, and outputs the generated excitation signal to the band determiner 13.

The band determiner 13 determines whether the target signal to be decoded is a narrow or wide band voice signal, using the LSPs provided from the LSP decoding unit 3.

In the case where it is determined that the target signal is a narrow band voice signal, the band determiner 13 outputs the provided excitation signal to the synthesis filter 14. The synthesis filter 14 generates a narrow band voice signal at an optimum level of calculation accuracy for decoding narrow band voice signal, using the provided LPCs and excitation signal, and outputs the generated voice signal to the post filter 16.

On the contrary, in the case where it is determined that the target signal is a wide band voice signal, the band determiner 13 outputs the provided excitation signal to the synthesis filter 15. The synthesis filter 15 generates a wide band voice signal at an optimum level of calculation accuracy for decoding the wide band voice signal, using the provided LPCs and excitation signal. The synthesis filter 15 outputs the generated wide band voice signal to the post filter 16.

The post filter 16 converts the provided narrow or wide band voice signal into an auditory satisfactory voice signal. After this, the post filter 16 outputs this voice signal to a predetermined circuit or device through the output unit 17.

Accordingly, in the structure where the modules for narrow band voice signals and the modules for wide band voice signals are set in the voice decoder according to this embodiment, voice signals can successfully be decoded with optimum levels of calculation accuracy which are adequate respectively for decoding the narrow and wide band voice signals. Specifically, when to decode the narrow band voice signals, an amount of calculation can be reduced to a minimum, and when to decode the wide band voice signals, the calculation can be achieved with a sufficient level of accuracy. Thus, voice signals can be decoded with high efficiency, and high quality voices can be reproduced from the decoded voice signals.

Second Embodiment

A voice decoder according to the second embodiment of the present invention will now be described with reference to the accompanying drawings.

The voice decoder according to the second embodiment can be used, in the case where gains of an adaptive code vector signal and pulse signal can be generated without using any LPCs.

Figure 2:
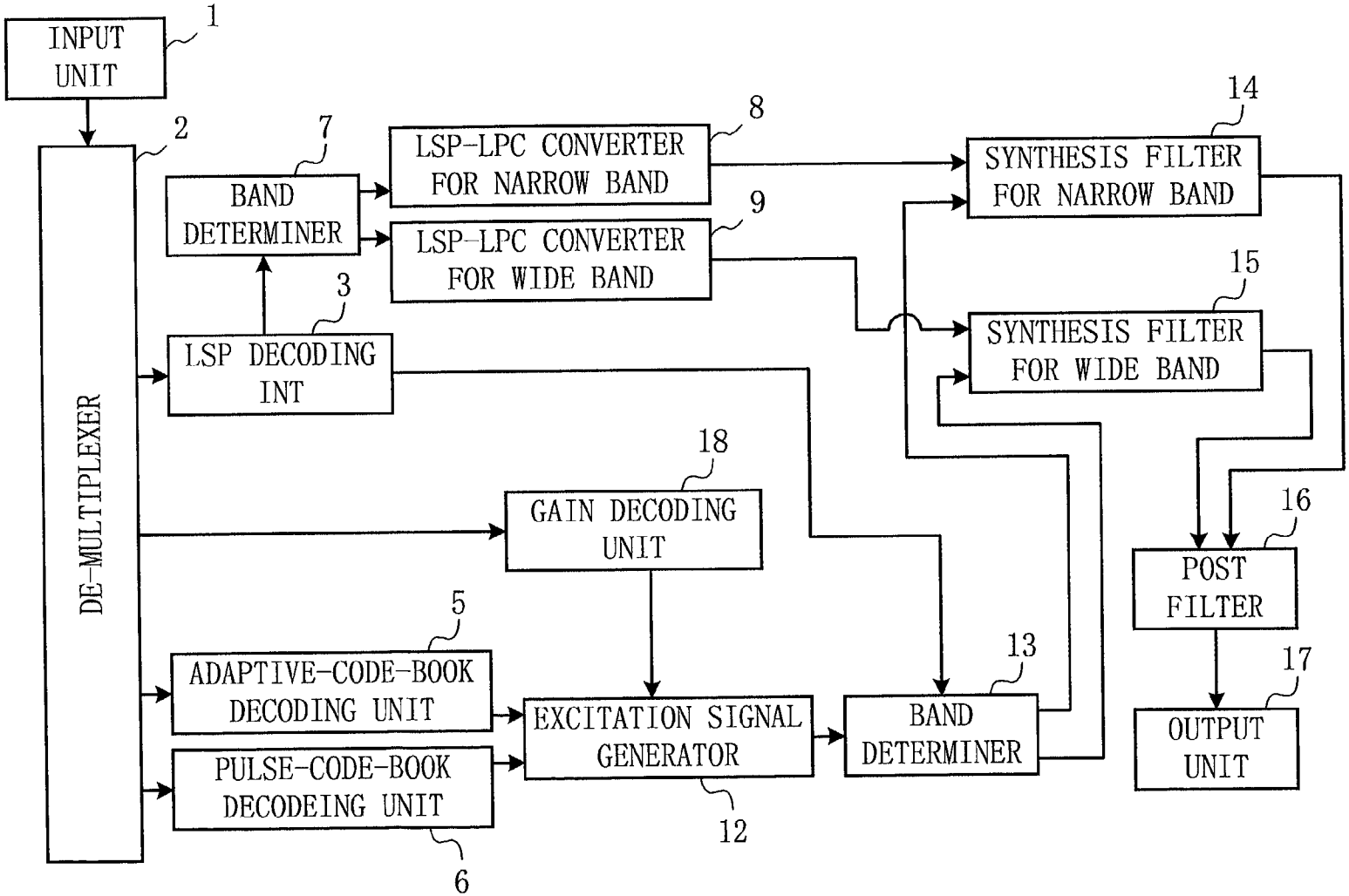
FIG. 2 is a diagram showing the structure of a voice decoder according to the second embodiment.
Figure 3:
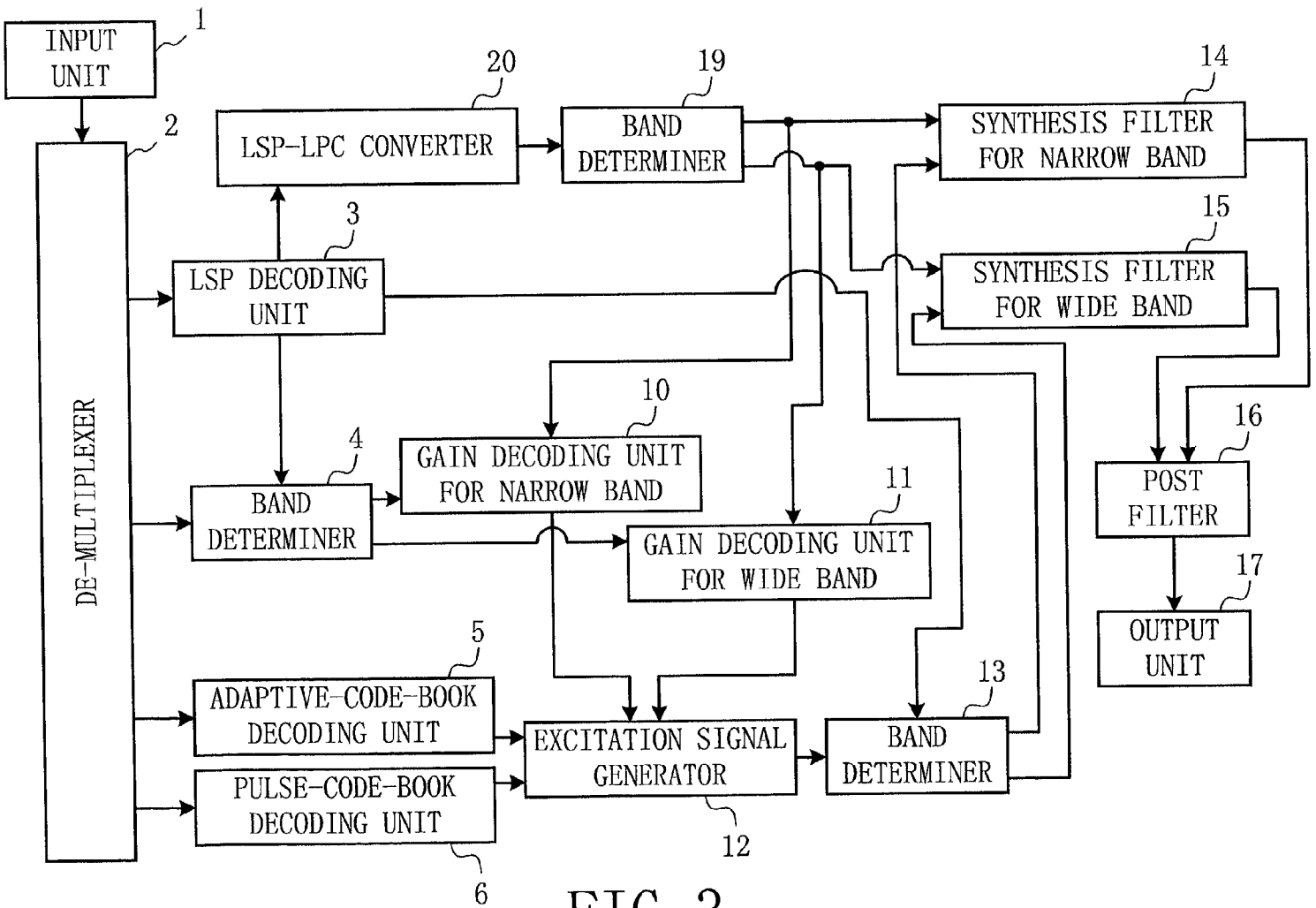
FIG. 3 is a diagram showing the structure of a voice decoder according to the third embodiment.

The voice decoder of this embodiment includes, as shown in FIG. 2, a gain decoding unit 18, in place of the band determiner 4, the gain decoding unit 10 and the gain decoding unit 11 described in the first embodiment.

LPCs output from the LSP-LPC converter 8 are sent only to the synthesis filter 14, whereas LPCs output from the LSP-LPC converter 9 are sent only to the synthesis filter 15. A gain index is sent from the de-multiplexer 2 to the gain decoding unit 18.

The gain decoding unit 18 generates a gain of the adaptive code vector signal and a gain of the pulse signal, based on the gain index sent from the de-multiplexer 2. The gain decoding unit 18 outputs thus generated gains to the excitation signal generator 12.

Any other structural elements and operations of the voice decoder of this embodiment are substantially the same as those described in the first embodiment.

As explained above, gains are generated without using any LPCs. Hence, even if the gain decoding unit 18 generates both of the gain for decoding the narrow band voice signal and the gain for decoding the wide band voice signal, any unnecessary calculations are not required and the quality of output voices can not be deteriorated. The structure of voice decoder can be made simpler than that of the voice decoder of the first embodiment, and hence realizing a smaller voice decoder than that of the first embodiment.

Third Embodiment

A voice decoder according to the third embodiment of the present invention will now be described with reference to the drawings.

The voice decoder according to the third embodiment can be used, in the case, for example, where almost the same amount of calculation for converting LSPs into LPCs is required both for the decoding of narrow band voice signals and the decoding of wide band voice signals.

The voice decoder according to the third embodiment includes a band determiner 19 and an LSP-LPC converter 20, in place of the band determiner 7 and the LSP-LPC converters 8 and 9 which are included in the voice decoder according to the first embodiment.

Those LSPs output from the LSP decoding unit 3 are sent to the band determiners 4 and 13 and the LSP-LPC converter 20. The LSP-LPC converter 20 converts the provided LSPs into LPCs in an appropriate level of calculation accuracy for decoding both narrow and wide band voice signals, and outputs the LPCs to the band determiner 19.

The band determiner 19 determines whether a target signal to be decoded is a narrow or wide band voice signal, using the sent LPCs. Note that the number of LPCs for use in decoding narrow band voice signals differs from the number of LPCs for use in decoding wide band voices signals. The band determiner 19 determines that the target signal is a narrow band voice signal, if the number of LPCs is less than a predetermined number, and determines that the target signal is a wide band voice signal, if the number of LPCs is equal to larger than the predetermined number.

In the case where the number of LPCs is less than the predetermined number, the band determiner 19 provides the gain decoding unit 10 and the synthesis filter 15 with the sent LPCs.

On the other hand, in the case where the number of LPCs is equal to larger than the predetermined number, the band determiner 19 provides the gain decoding unit 11 and the synthesis filter 15 with the sent LPCs.

Any other structural elements and operations of the voice decoder of this embodiment are substantially the same as those of the voice decoder according to the first embodiment of the present invention.

As explained above, almost the same amount of calculation for converting LSPs into LPCs is required both for the decoding of narrow band voice signals and the decoding of wide band voice signals. Even if the LSP-LPC converter 20 generates both of the LPCs for narrow band and the LPCs for wide band, any unnecessary calculations are not required and the quality of the output voice can not be deteriorated. The structure of the voice decoder of this embodiment can be made simpler than the structure of the voice decoder according to the first embodiment, and hence enabling to form a smaller voice decoder than that of the first embodiment.

Figure 4:
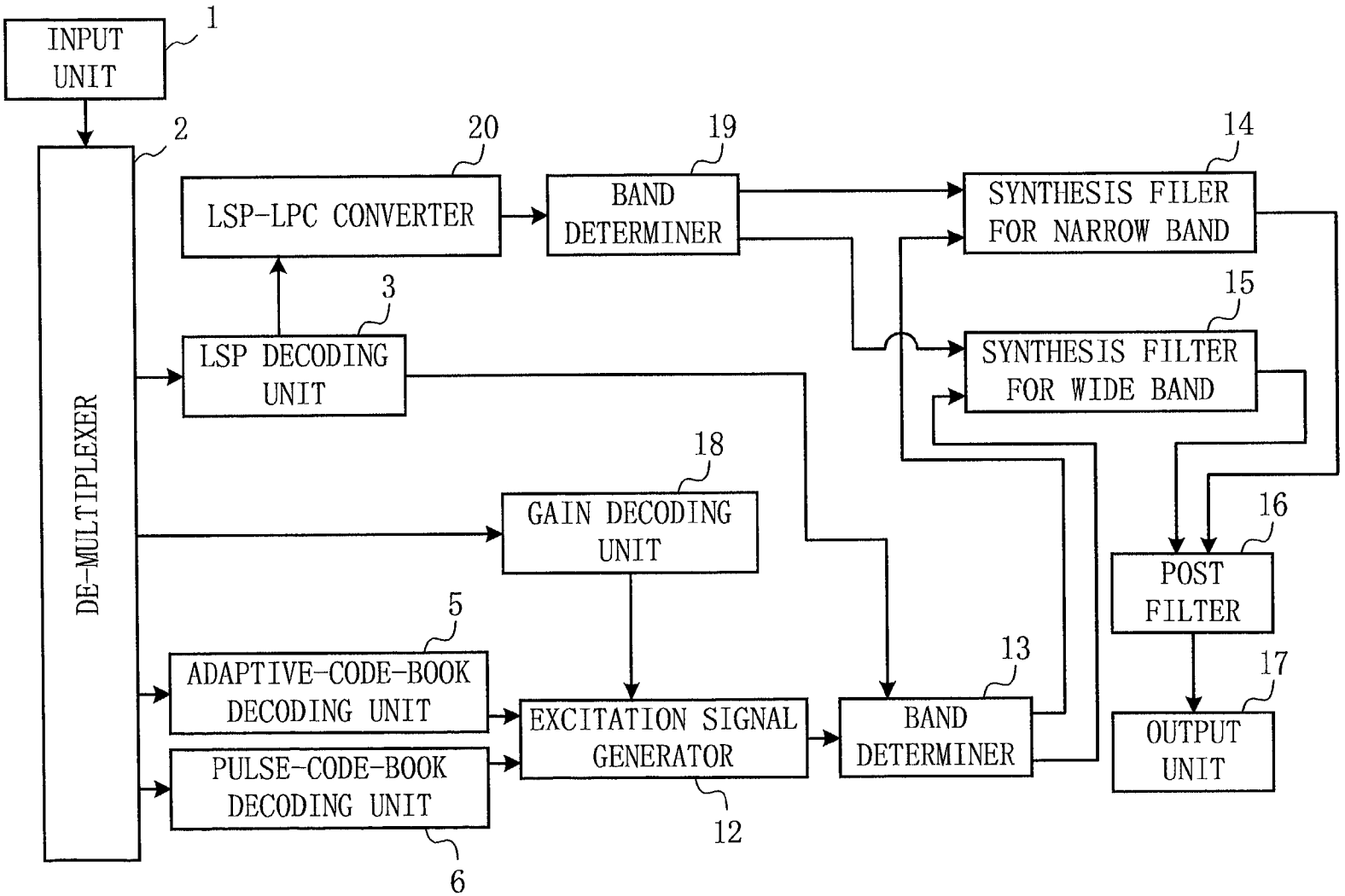
FIG. 4 is a diagram showing the structure of a voice decoder which is formed in combination of the structures of FIGS. 2 and 3.

If the gains can be generated without any LPCs, and in the case where almost the same amount of calculation for converting LSPs into LPCs is required both for the decoding of the narrow band voice signals and the decoding of the wide band voice signals, the voice decoders according to the second and third embodiments may be combined into one voice decoder. Specifically, as shown in FIG. 4, the band determiner 19 and the LSP-LPC converter 20 may be included in the voice decoder of the second embodiment, in place of the band determiner 7 and LSP-LPC converters 8 and 9. This realizes a voice decoder which is smaller in size than the size of the voice decoders of the second and third embodiments.

The band determiner 13 may determine whether a target signal to be decoded is a narrow or wide band voice signal, using an excitation signal instead of the LSPs. Particularly, an amount of data included in one frame excitation signal differs between the case where to decode the narrow band voice signal and the case where to decode the wide band voice signal. In the case where the amount of data included in the single frame excitation signal is less than a predetermined amount, the band determiner 13 may determine that the target signal is a narrow band voice signal. On the other hand, in the case where the amount of data included in the single frame excitation signal is equal to or larger than a predetermined data amount, the band determiner 13 may determine that the target signal is a wide band voice signal.

The voice decoders according to the above embodiments may be realized with hardware having modules each including a dedicated circuit. The voice decoders may be realized with a data processor, such as a DSP (Digital Signal Processor), an EM (Embedded Microprocessor) or an ASIC (Application Specific Integrated Circuit).

Figure 5:
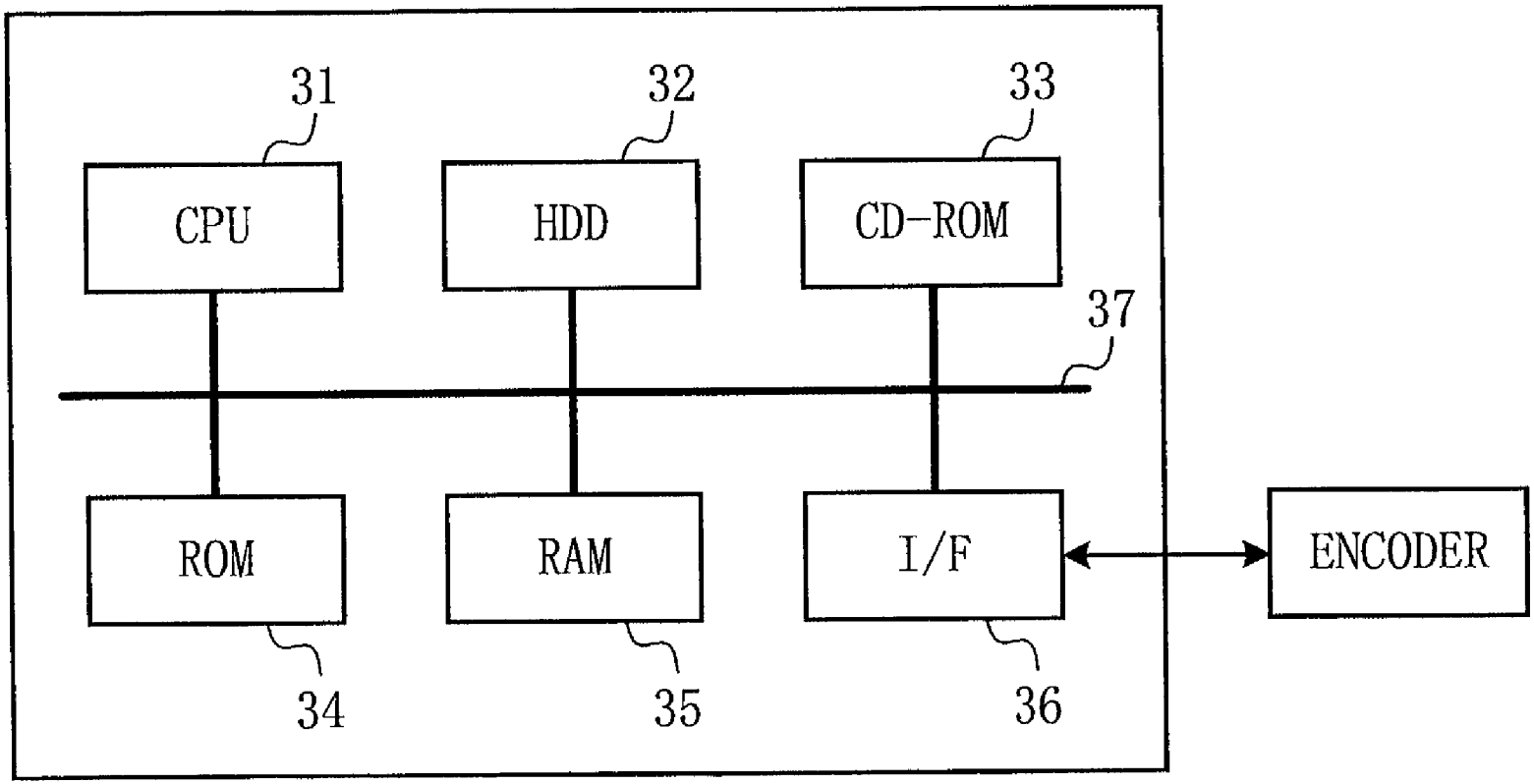
FIG. 5 is a diagram exemplarily showing the structure of a computer for realizing a voice decoder.

The voice decoder of the present invention may be realized by a general computer. The computer comprises a CPU (Central Processing Unit) 31, an HDD (Hard Disc Driver) 32, a CD-ROM (Compact Disc-Read Only Memory) 33, a ROM (Read Only Memory) 34, a RAM (Random Access Memory) 35 and an interface (I/F) 36 which are all connected with each other through a bus 37, as shown in FIG. 5. In this case, a program and data for controlling the computer to execute the above operations may be stored in the HDD 32, the CD-ROM 33, the ROM 34 or the RAM 35, and retrieved and executed by the CPU 31.

The program and data for controlling a computer to execute the above-described operations may be recorded on a medium (a floppy disk, CD-ROM, DVD or the like) and distributed, and the program may be installed into the computer and run on an OS (Operating System) to execute the above described operations, thereby realizing the apparatus of the present invention. The above program and data may be stored in a disk device or the like included in a server device on the Internet, embedded in a carrier wave, and the program and data embedded in the carrier wave may be downloaded into the computer so as to realize the apparatus of the present invention.

Various embodiments and changes may be made thereonto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

This application is based on Japanese Patent Application No. 2000-332482 filed on Oct. 31, 2000, and including specification, claims, drawings and summary. The disclosure of the above Japanese Patent Application is incorporated herein by reference in its entirety.

What is claimed is:

1. A voice decoder comprising:

a first voice decoding circuit which is specialized for decoding at least one encoded narrow band voice signal;

a second voice decoding circuit which is specialized for decoding at least one encoded wide band voice signal; and a band determination circuit which determines whether a target signal to be decoded is an encoded narrow band voice signal or an encoded wide band voice signal based on data solely within the encoded narrow band voice signal or the encoded wide band voice signal that forms the target signal, and wherein:

said band determination circuit supplies said first voice decoding circuit with the target signal in a case where it is determined that the target signal is the encoded narrow band voice signal, and supplies said second voice decoding circuit with the target signal in a case where it is determined that the target signal is the encoded wide band voice signal;

said first voice decoding circuit decodes the target signal supplied from said band determination circuit; and said second voice decoding circuit decodes the target signal supplied from said band determination circuit.

2. The voice decoder according to claim 1, wherein said band determination circuit includes:

an LSP generation circuit which generates at least one LSP (Linear Spectrum Pair) from an index included in the target signal; and an LSP determination circuit which determines whether the target signal is the encoded narrow band voice signal or the encoded wide band voice signal, by determining whether a number of the at least one LSP is equal to or larger than a predetermined number.

3. The voice decoder of claim 1, wherein the band determination circuit supplies the first voice decoding circuit with the target signal and does not supply the second voice decoding circuit with the target signal in the case where it is determined that the target signal is the encoded narrow band voice signal;

wherein the band determination circuit supplies the second voice decoding circuit with the target signal and does not supply the first voice decoding circuit with the target signal in the case where it is determined that the target signal is the encoded wide band voice signal;

wherein the first voice decoding circuit decodes the target signal when the target signal is supplied to the first voice decoding circuit from the band determination circuit; and wherein the second voice decoding circuit decodes the target signal when the target signal is supplied to the second voice decoding circuit from the band determination circuit.

4. A voice decoder comprising:

an LSP generation circuit which generates at least one LSP from an encoded narrow band voice signal or an encoded wide band voice signal as a target signal to be decoded;

a converter which converts the at least one LSP into at least one LPC (Linear Prediction Code);

an excitation signal generator which generates an excitation signal for use in linear prediction synthesis, from the target signal; and a voice signal generator which generates a narrow band voice signal or a wide band voice signal by performing linear prediction synthesis using the at least one LPC and the excitation signal, and wherein:

said converter comprises:

a first conversion circuit which converts the at least one LSP into the at least one LPC with an adequate level of calculation accuracy for decoding narrow band voice signals, a second conversion circuit which converts the at least one LSP into the at least one LPC with an adequate level of calculation accuracy for decoding wide band voice signals, and a first supply circuit which determines whether the target signal is the encoded narrow band voice signal or the encoded wide band voice signal by determining whether a number of the at least one LSP is equal to or larger than a predetermined number, supplies said first conversion circuit with the at least one LSP in a case where it is determined that the target signal is the encoded narrow band voice signal, and supplies said second conversion circuit with the at least one LSP in a case where it is determined that the target signal is the encoded wide band voice signal; and said voice signal generator comprises:

a first synthesis filter which performs linear prediction synthesis using the at least one LPC generated by said first conversion circuit and the excitation signal, with an adequate level of calculation accuracy for decoding narrow band voice signals, a second synthesis filter which performs linear prediction synthesis using the at least one LPC generated by said second conversion circuit and the excitation signal, with an adequate level of calculation accuracy for decoding wide band voice signals, and a second supply circuit which determines whether the target signal is the encoded narrow band voice signal or the encoded wide band voice signal by determining whether a number of the at least one LSP is equal to or larger than a predetermined number, supplies said first synthesis filter with the excitation signal in a case where it is determined that the target signal is the encoded narrow band voice signal, and supplies said second synthesis filter with the excitation signal in a case where it is determined that the target signal is the encoded wide band voice signal.

5. The voice decoder according to claim 4, wherein said excitation signal generator comprises:

a vector signal generation circuit which generates an adaptive code vector signal from the target signal to be decoded;

a pulse signal generation circuit which generates a pulse signal from the target signal;

a first gain generation circuit which generates gains of the respective adaptive code vector signal and pulse signal using the target signal and the at least one LPC generated by said first conversion circuit, with an adequate level of calculation accuracy for decoding narrow band voice signals;

a second gain generation circuit which generates gains of the respective adaptive code vector signal and pulse signal using the target signal and the at least one LPC generated by said second conversion circuit, with an adequate level of calculation accuracy for decoding wide band voice signals;

a third supply circuit which determines whether the target signal is the encoded narrow band voice signal or the encoded wide band voice signal by determining whether a number of the at least one LSP is equal to or larger than a predetermined number, supplies said first gain generation circuit with the target signal in a case where it is determined that the target signal is the encoded narrow band voice signal, and supplies said second gain generation circuit with the target signal in a case where it is determined that the target signal is the encoded wide band voice signal; and an excitation signal generation circuit which generates the excitation signal, using the gains generated by said first or second gain generation circuit, the adaptive code vector signal and the pulse signal.

6. The voice decoder of claim 4, wherein the first supply circuit supplies the first conversion circuit with the at least one LSP and does not supply the second conversion circuit with the at least one LSP in the case where it is determined that the target signal is the encoded narrow band voice signal;

wherein the first supply circuit supplies the second conversion circuit with the at least one LSP and does not supply the first conversion circuit with the at least one LSP in the case where it is determined that the target signal is the encoded wide band voice signal;

wherein the second supply circuit supplies the first synthesis filter with the excitation signal and does not supply the second synthesis filter with the excitation signal in the case where it is determined that the target signal is the encoded narrow band voice signal; and wherein the second supply circuit supplies the second synthesis filter with the excitation signal and does not supply the first synthesis filter with the excitation signal in the case where it is determined that the target signal is the encoded wide band voice signal.

7. A voice decoder comprising:

an LSP generation circuit which generates at least one LSP from an encoded narrow band voice signal or an encoded wide band voice signal as a target signal to be decoded;

a converter which converts the at least one LSP into at least one LPC;

an excitation signal generator which generates an excitation signal for use in performing linear predication synthesis from the target signal; and a voice signal generator which generates a narrow band voice signal or wide band voice signal, by performing linear prediction synthesis using the at least one LPC and the excitation signal, and wherein said voice signal generator includes:

a first synthesis filter which performs linear prediction synthesis using the at least one LPC and excitation signal, with an adequate level of calculation accuracy for decoding narrow band voice signals, a second synthesis filter which performs linear prediction synthesis using the at least one LPC and excitation signal, with an adequate level of calculation accuracy for decoding wide band voice signals;

a first supply circuit which determines whether the target signal is the encoded narrow band voice signal or the encoded wide band voice signal by determining whether a number of the at least one LPC is equal to or larger than a predetermined number, supplies said first synthesis filter with the at least one LPC in a case where it is determined that the target signal is the encoded narrow band voice signal, and supplies said second synthesis filter with the at least one LPC in a case where it is determined that the target signal is the encoded wide band voice signal, and a second supply circuit which determines whether the target signal is the encoded narrow band voice signal or the encoded wide band voice signal by determining whether a number of the at least one LSP is equal to or larger than a predetermined number, supplies said first synthesis filter with the excitation signal in a case where it is determined that the target signal is the encoded narrow band voice signal, and supplies said second filter with the excitation signal in a case where it is determined that the target signal is the encoded wide band voice signal.

8. The voice decoder according to claim 7, wherein said excitation signal generator includes:

a vector signal generation circuit which generates an adaptive code vector signal from the target signal to be decoded;

a pulse signal generation circuit which generates a pulse signal from the target signal to be decoded;

a first gain generation circuit which generates gains of the respective adaptive code vector signal and the pulse signal using the at least one LPC and the target signal, with an adequate level of calculation accuracy for decoding narrow band voice signals;

a second gain generation circuit which generates gains of the respective adaptive code vector signal and the pulse signal using the at least one LPC and the target signal, with an adequate level of calculation accuracy for decoding wide band voice signals;

a third supply circuit which determines whether the target signal is the encoded narrow band voice signal or the encoded wide band voice signal by determining whether a number of the at least one LSP is equal to or larger than a predetermined number, supplies said first gain generation circuit with the target signal in a case where it is determined that the target signal is the encoded narrow band voice signal, and supplies said second gain generation circuit with the target signal in a case where it is determined that the target signal is the encoded wide band voice signal; and an excitation signal generation circuit which generates the excitation signal, using the gains generated by said first or second gain generation circuit, the adaptive code vector signal and the pulse signal, and wherein said first supply circuit supplies said first gain decoding circuit with the at least one LPC in a case where it is determined that the target signal is the encoded narrow band voice signal, and supplies said second gain decoding circuit with the at least one LPC in a case where it is determined that the target signal is the encoded wide band voice signal.

9. The voice decoder of claim 7, wherein the first supply circuit supplies the first synthesis filter with the at least one LPC and does not supply the second synthesis filter with the at least one LPC in the case where it is determined that the target signal is the encoded narrow band voice signal;

wherein the first supply circuit supplies the second synthesis filter with the at least one LPC and does not supply the first synthesis filter with the at least one LPC in the case where it is determined that the target signal is the encoded wide band voice signal;

wherein the second supply circuit supplies the first synthesis filter with the excitation signal and does not supply the second synthesis filter with the excitation signal in the case where it is determined that the target signal is the encoded narrow band voice signal; and wherein the second supply circuit supplies the second synthesis filter with the excitation signal and does not supply the first synthesis filter with the excitation signal in the case where it is determined that the target signal is the encoded wide band voice signal.

10. A voice decoding method comprising:

determining whether a target signal to be decoded is an encoded narrow band voice signal or an encoded wide band voice signal based on data solely within the encoded narrow band voice signal or the encoded wide band voice signal that forms the target signal;

decoding the target signal with an adequate level of calculation accuracy for decoding narrow band voice signals, in a case where it is determined that the target signal is the encoded narrow band voice signal; and decoding the target signal with an adequate level of calculation accuracy for decoding wide band voice signals, in a case where it is determined that the target signal is the encoded wide band voice signal.

11. The voice decoding method according to claim 10, wherein said step of determining whether a target signal to be decoded is an encoded narrow band voice signal or an encoded wide band voice signal includes:

generating at least one LSP by decoding an index included in the target signal; and determining whether the target signal is the encoded narrow band voice signal or the encoded wide band voice signal, by determining whether a number of the at least one LSP is equal to or larger than a predetermined number.

12. A storage medium storing a program for causing a computer to execute a voice decoding process, the process comprising:

determining whether a target signal to be decoded is an encoded narrow band voice signal or an encoded wide band voice signal based on data solely within the encoded narrow band voice signal or the encoded wide band voice signal that forms the target signal;

decoding the target signal with an adequate level of calculation accuracy for decoding narrow band voice signals, in a case where it is determined that the target encoded narrow band voice signal; and decoding the target signal with an adequate level of calculation accuracy for decoding wide band voice signals, in a case where it is determined that the target signal is the encoded wide band voice signal.

* * * * *